US009448013B2

(12) United States Patent
Ito et al.

(10) Patent No.: US 9,448,013 B2
(45) Date of Patent: Sep. 20, 2016

(54) PLATE HEAT EXCHANGER AND HEAT PUMP APPARATUS

(75) Inventors: Daisuke Ito, Tokyo (JP); Takehiro Hayashi, Tokyo (JP); Kazunori Matsunaga, Tokyo (JP); Shinichi Uchino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 152 days.

(21) Appl. No.: 14/005,586

(22) PCT Filed: Apr. 18, 2011

(86) PCT No.: PCT/JP2011/059543

§ 371 (c)(1),
(2), (4) Date: Sep. 17, 2013

(87) PCT Pub. No.: WO2012/143998

PCT Pub. Date: Oct. 26, 2012

(65) Prior Publication Data

US 2014/0008047 A1 Jan. 9, 2014

(51) Int. Cl.

| | |
|---|---|
| ***F28F 3/00*** | (2006.01) |
| ***F28F 3/08*** | (2006.01) |
| ***F28F 13/00*** | (2006.01) |

(Continued)

(52) U.S. Cl.

CPC ..... *F28F 3/025* (2013.01); *F28D 9/005* (2013.01); *F28F 3/046* (2013.01); *F28F 3/12* (2013.01); *F28F 2275/04* (2013.01)

(58) Field of Classification Search

CPC .. F28D 9/0031; F28D 9/0037; F28D 9/0043; F28D 9/005; F28F 3/025; F28F 3/046; F28F 3/08; F28F 3/086; F28F 3/04

USPC ..... 165/166, 167, 146

See application file for complete search history.

(56) References Cited

U.S. PATENT DOCUMENTS 4,014,385 A * 3/1977 Wright ..... 165/167
5,413,872 A * 5/1995 Faigle ..... 428/603

(Continued)

FOREIGN PATENT DOCUMENTS

CN 101256057 A 9/2008
EP 1 475 596 A2 11/2004

(Continued)

OTHER PUBLICATIONS

International Search Report of the International Searching Authority mailed Jul. 19, 2011 for the corresponding international application No. PCT/JP2011/059543 (and English translation).

(Continued)

*Primary Examiner* — Allen Flanigan
*Assistant Examiner* — Jason Thompson
(74) *Attorney, Agent, or Firm* — Posz Law Group, PLC

(57) ABSTRACT

A plate heat exchanger includes a stack of a plurality of plates each having an inlet and an outlet for a fluid. Each adjacent two of the plates are bonded to each other at regions thereof where top parts of the wavy portion provided in a lower one of the plates and bottom parts of the wavy portion provided in an upper one of the plates overlap each other when seen in the stacking direction. Particularly, a top part included in the top parts of the wavy portion of the lower plate and being adjacent to each of the inlet and the outlet has a planar shape.

11 Claims, 17 Drawing Sheets

(51) Int. Cl.

| | |
|---|---|
| ***F28F 3/02*** | (2006.01) |
| ***F28F 3/04*** | (2006.01) |
| ***F28D 9/00*** | (2006.01) |
| ***F28F 3/12*** | (2006.01) |

(56) References Cited

U.S. PATENT DOCUMENTS

| | | | | |
|---|---|---|---|---|
| 6,389,696 | B1 * | 5/2002 | Heil et al. | 29/890.039 |
| 2003/0131979 | A1 * | 7/2003 | Kim | 165/164 |
| 2004/0256083 | A1 | 12/2004 | Rehberg et al. | |
| 2005/0155749 | A1 * | 7/2005 | Memory et al. | 165/167 |
| 2005/0178536 | A1 * | 8/2005 | Blomgren et al. | 165/167 |
| 2007/0227716 | A1 * | 10/2007 | Dahlberg | 165/167 |
| 2008/0029257 | A1 * | 2/2008 | Nilsson | 165/167 |
| 2008/0210414 | A1 | 9/2008 | Blomgren et al. | |
| 2009/0032110 | A1 * | 2/2009 | Straza | 137/1 |
| 2009/0178793 | A1 | 7/2009 | Larsson et al. | |

FOREIGN PATENT DOCUMENTS

| | | | |
|---|---|---|---|
| JP | 06-109394 | A | 4/1994 |
| JP | 07-243781 | A | 9/1995 |
| JP | 07-260386 | A | 10/1995 |
| JP | 3026231 | U | 4/1996 |
| JP | 08-271173 | A | 10/1996 |
| JP | 11-173771 | A | 7/1999 |
| JP | 11-281283 | A | 10/1999 |
| JP | 2000-193390 | A | 7/2000 |
| JP | 2000-266489 | A | 9/2000 |
| JP | 3328329 | B2 | 9/2002 |
| JP | 2004-011936 | A | 1/2004 |
| JP | 2005-514576 | A | 5/2005 |
| JP | 2009-521658 | A | 6/2009 |
| JP | 2010-078286 | A | 4/2010 |
| JP | 2010216754 | A | 9/2010 |
| WO | 99/44003 | A1 | 9/1999 |
| WO | 03/058142 | A | 7/2003 |
| WO | 2007/036963 | A1 | 4/2007 |
| WO | 2007/073304 | A1 | 6/2007 |
| WO | 2009/117885 | A1 | 10/2009 |
| WO | 2009/151399 | A1 | 12/2009 |
| WO | 2010/106717 | A1 | 9/2010 |

OTHER PUBLICATIONS

Office Action dated Jan. 27, 2015 issued in corresponding CN patent application No. 201180070214.0 (and English translation).

Office Action mailed Feb. 24, 2015 issued in corresponding KR patent application No. 10-2013-7025927 (and English translation).

Office Action mailed on Aug. 8, 2014 in corresponding KR Application No. 10-2013-7025927 (with English translation).

Office Action mailed on Dec. 16, 2014 in corresponding JP Application No. 2013-510753 (with English translation).

Extended European Search Report (EESR) mailed on Dec. 3, 2014 in corresponding EP patent application No. 11863909.5.

Office Action mailed Sep. 1, 2015 in the corresponding JP application No. 2013-510753 (with English translation).

Office Action issued Sep. 22, 2015 in the corresponding CN application No. 201180070214.0 (with English translation).

* cited by examiner

PLATE HEAT EXCHANGER AND HEAT PUMP APPARATUS

CROSS REFERENCE TO RELATED APPLICATION

This application is a U.S. national stage application of International Application No. PCT/JP2011/059543 filed on Apr. 18, 2011.

TECHNICAL FIELD

The present invention relates to a plate heat exchanger including a plurality of heat transfer plates that are stacked.

BACKGROUND ART

Heat transfer plates included in a plate heat exchanger each have an inlet and an outlet, and a wavy portion provided between the inlet and the outlet and waving in a direction in which the heat transfer plates are stacked. In such a plate heat exchanger, top parts of a wavy portion provided in one heat transfer plate that is on the lower side and bottom parts of a wavy portion provided in another heat transfer plate that is on the upper side overlap each other when seen in the stacking direction, forming overlapping parts, and are bonded to each other at the overlapping parts by brazing.

If waves of the wavy portion provided in each of the heat transfer plates do not have a uniform height, gaps may be provided between adjacent ones of the heat transfer plates even at the overlapping parts, that is, non-bonded parts where the heat transfer plates are not bonded to each other may occur. In general, a wavy portion of a heat transfer plate is formed by presswork. One of waves in the wavy portion that is provided adjacent to each of an inlet and an outlet (hereinafter referred to as "the first wave") is positioned far from a crank shaft of a press machine and is therefore likely to have an error in wave height. Hence, the first wave tends to have a non-bonded part and to have low bonding strength.

Furthermore, a region near each of the inlet and the outlet is a planar surface not having the wavy portion, and the area thereof that is subject to pressure is large. Therefore, the stress working on a bonded part of the first wave that is provided adjacent to each of the inlet and the outlet is larger than the stress working on a heat transfer surface area in which the wavy portion is provided. Hence, the overlapping part of the first wave that is provided adjacent to each of the inlet and the outlet particularly needs to have high bonding strength.

Patent Literature 1 discloses a plate heat exchanger including walls provided around an inlet and an outlet. Patent Literature 2 discloses a plate heat exchanger including walls (reinforcing grooves) provided on a heat transfer surface area.

CITATION LIST

Patent Literature

Patent Literature 1: Japanese Unexamined Patent Application Publication No. 6-109394

Patent Literature 2: Japanese Unexamined Patent Application Publication No. 7-260386

SUMMARY OF INVENTION

Technical Problem

If a wall as a strengthening measure is provided around each of an inlet and an outlet as in the plate heat exchanger disclosed by Patent Literature 1, each heat transfer plate has a complicated shape, making it difficult to provide high accuracy in the height of the wall. Moreover, the wall, which is bonded to an adjacent heat transfer plate, has non-bonded parts in some regions thereof and is therefore susceptible to pressure load.

As in the plate heat exchanger disclosed by Patent Literature 2, a wall (reinforcing groove) provided on a heat transfer surface is vulnerable to deformation that may occur in a direction in which heat transfer plates are stacked. Therefore, the area that is subject to pressure is large, and the wall does not improve the strength in a region near each of the inlet and the outlet that tends to be damaged. Moreover, if a wall is provided on a heat transfer surface, the pressure loss of a fluid increases.

The present invention is to increase the compressive strength of a plate heat exchanger.

Solution to Problem

A plate heat exchanger according to the present invention is a plate heat exchanger in which a plurality of plates each having an inlet and an outlet for a fluid are stacked, and a passage through which the fluid having flowed therein from the inlet flows toward the outlet is provided between each adjacent two of the plates, wherein each of the plates has a wavy portion provided between the inlet and the outlet and waving in a plate stacking direction, the wavy portion having a plurality of top parts and a plurality of bottom parts provided alternately from a side on which the inlet is provided toward a side on which the outlet is provided, wherein the adjacent two plates are bonded to each other at regions thereof where the top parts of the wavy portion provided in a lower one of the plates that is on a lower side and the bottom parts of the wavy portion provided in an upper one of the plates that is on an upper side overlap each other when seen in the stacking direction, and wherein an adjacent top part of the top parts of the wavy portion of the lower plate and being adjacent to at least one of the inlet and the outlet has a planar shape.

Advantageous Effects of Invention

In the plate heat exchanger according to the present invention, since the top part of the first wave (the adjacent to part) has a planar shape, the strength of bonding by brazing is high. Accordingly, the bonding strength at the first wave is high, and the compressive strength of the plate heat exchanger is high.

DESCRIPTION OF EMBODIMENTS

Embodiment 1

A basic configuration of a plate heat exchanger 30 according to Embodiment 1 will now be described.

Figure 1:
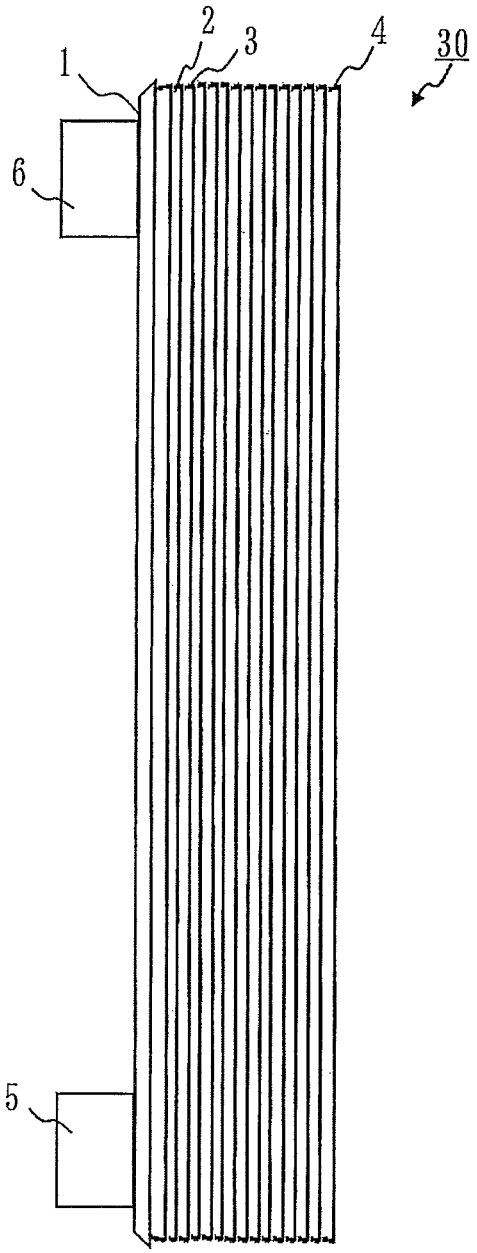
FIG. 1 is a side view of a plate heat exchanger 30.
Figure 2:
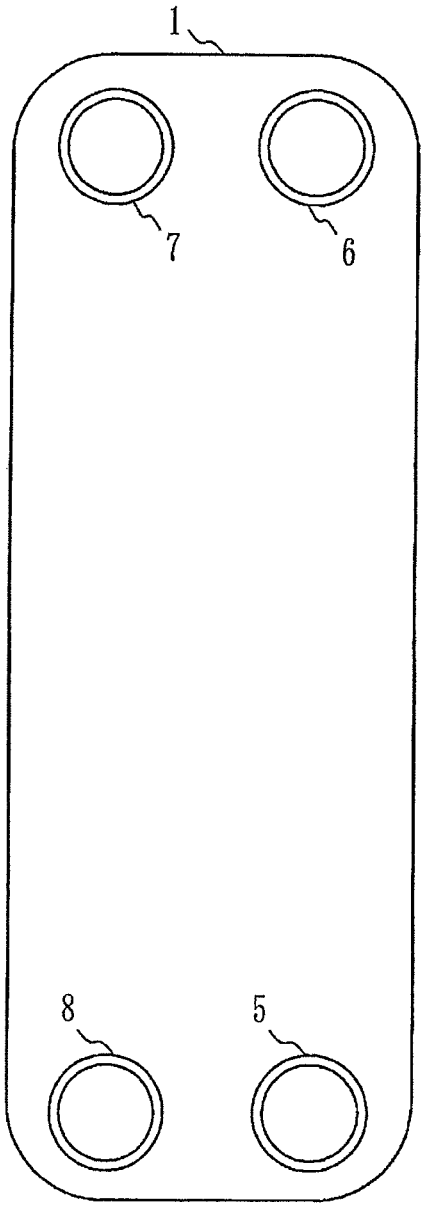
FIG. 2 is a front view of a reinforcing side plate 1.
Figure 3:
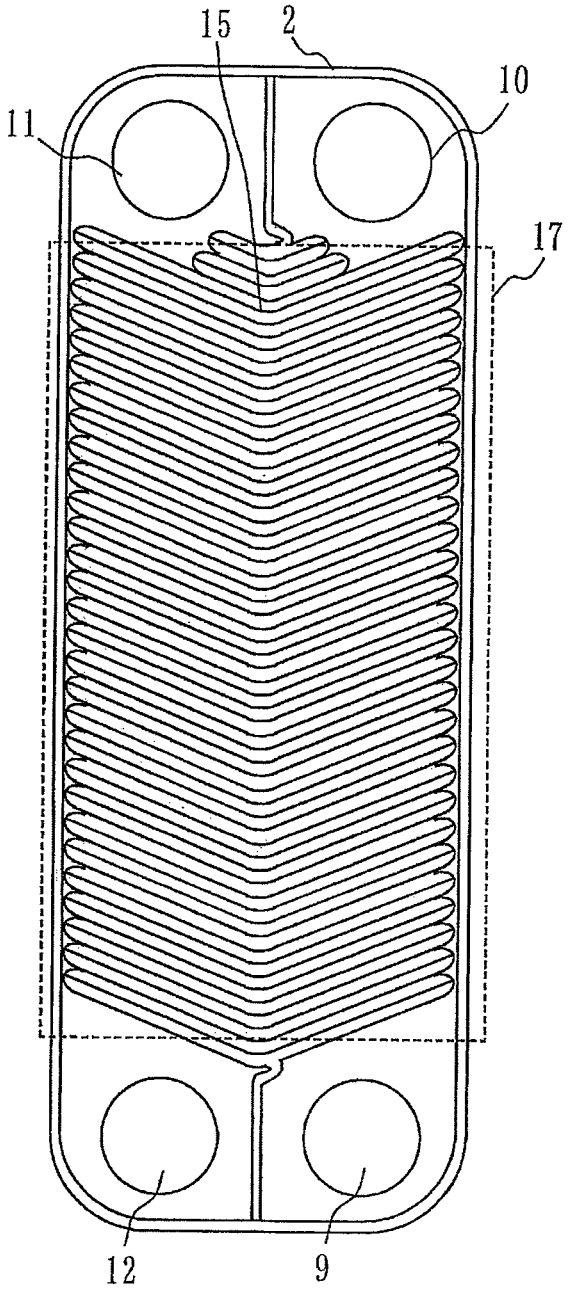
FIG. 3 is a front view of a heat transfer plate 2.
Figure 4:
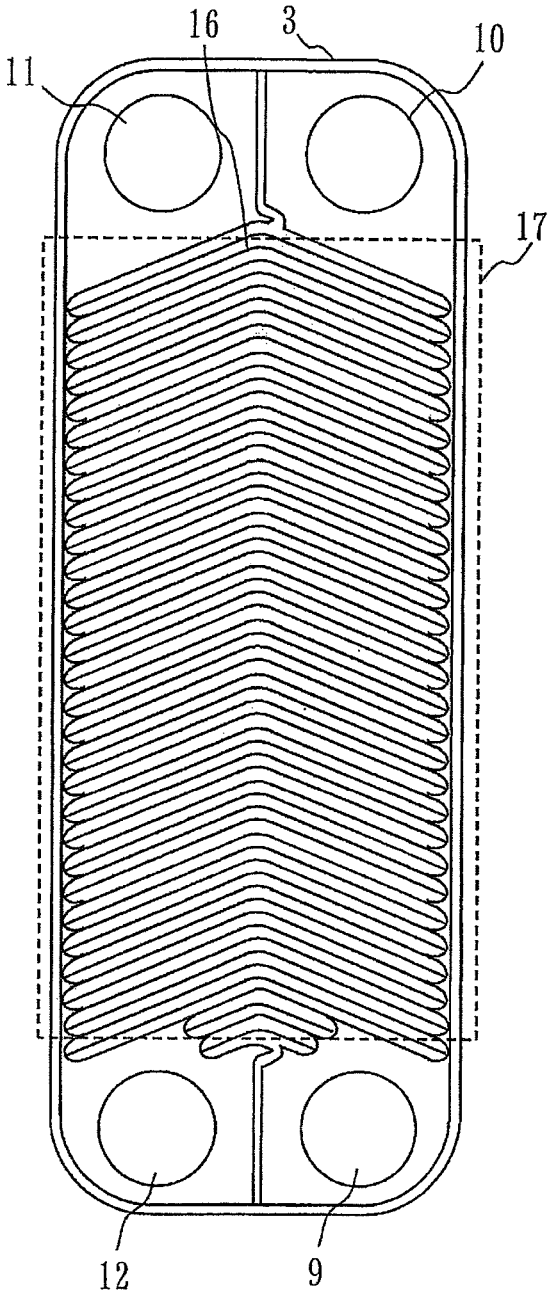
FIG. 4 is a front view of a heat transfer plate 3.
Figure 5:
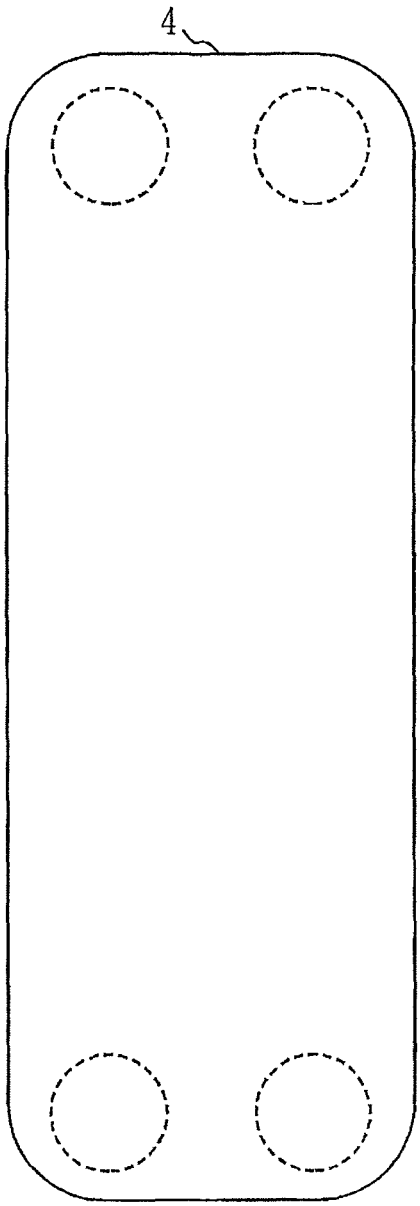
FIG. 5 is a front view of a reinforcing side plate 4.
Figure 6:
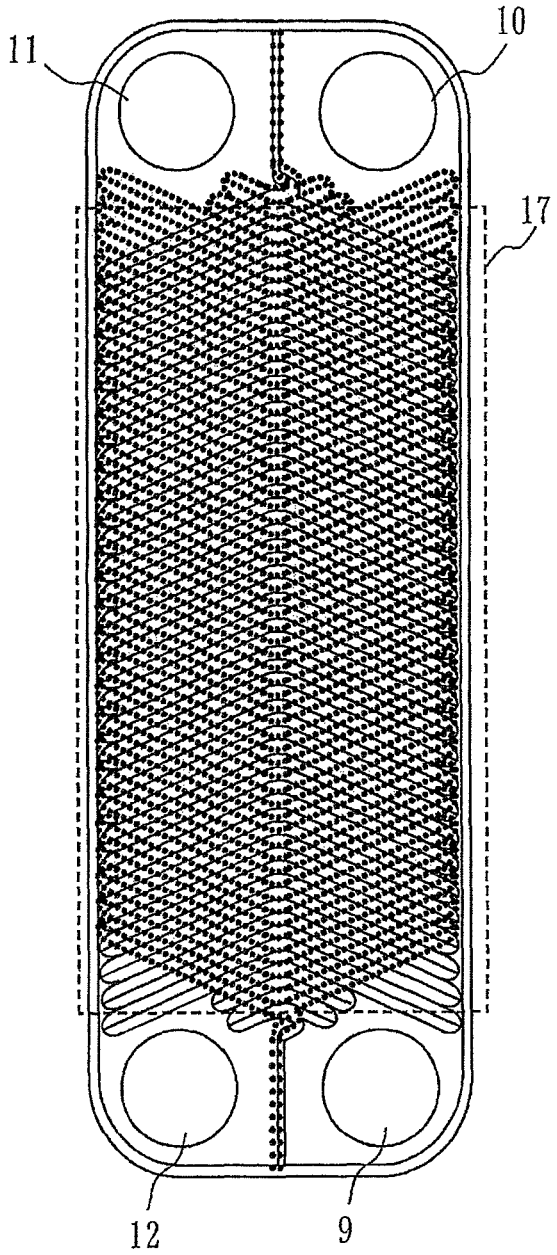
FIG. 6 is a diagram illustrating a state where the heat transfer plate 2 and the heat transfer plate 3 are stacked.
Figure 7:
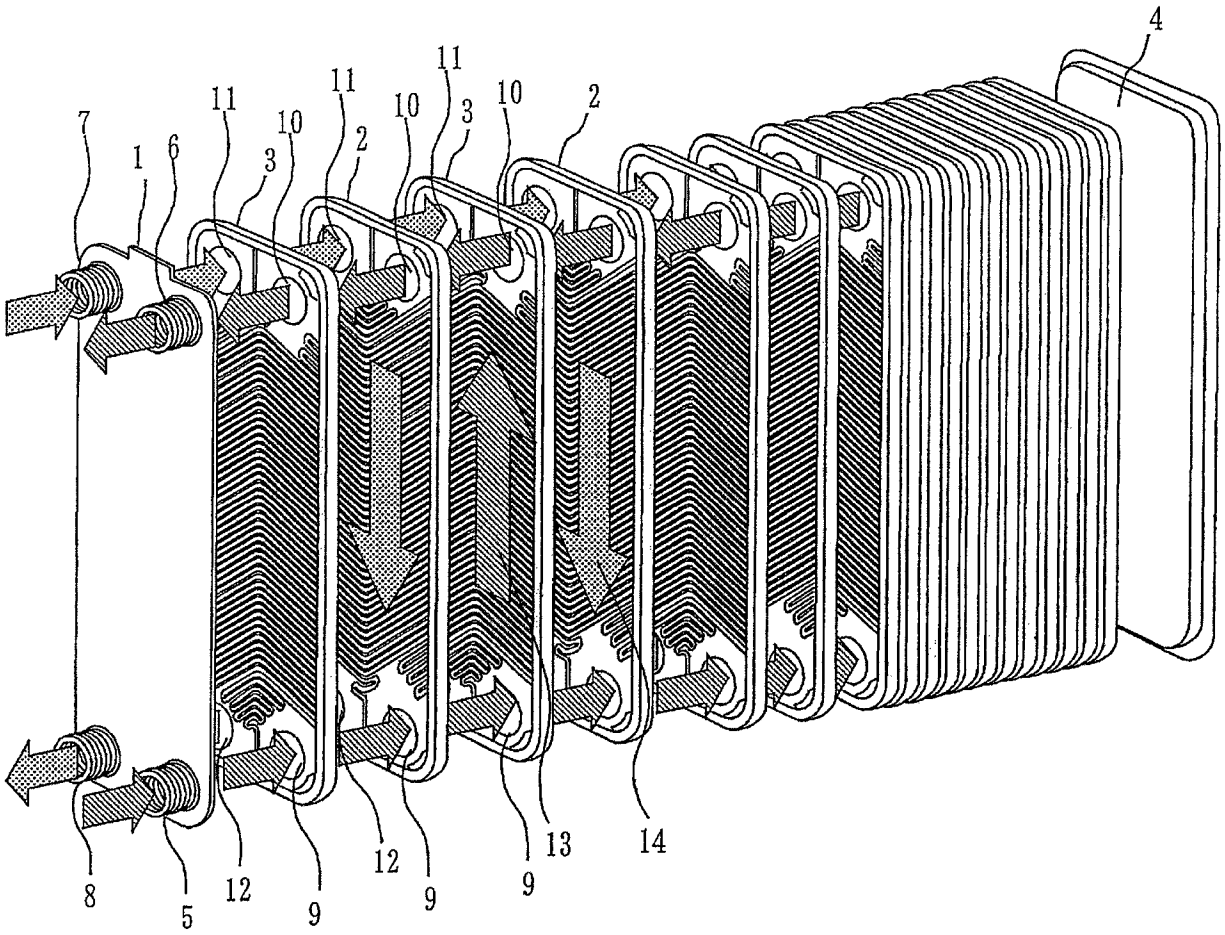
FIG. 7 is an exploded perspective view of the plate heat exchanger 30.

FIG. 1 is a side view of the plate heat exchanger 30. FIG. 2 is a front view of a reinforcing side plate 1 (seen in a stacking direction). FIG. 3 is a front view of a heat transfer plate 2. FIG. 4 is a front view of a heat transfer plate 3. FIG. 5 is a front view of a reinforcing side plate 4. FIG. 6 is a diagram illustrating a state where the heat transfer plate 2 and the heat transfer plate 3 are stacked. FIG. 7 is an exploded perspective view of the plate heat exchanger 30.

As illustrated in FIG. 1, the plate heat exchanger 30 includes heat transfer plates 2 and heat transfer plates 3 that are alternately stacked. The plate heat exchanger 30 further includes the reinforcing side plate 1 provided on the frontmost side thereof and the reinforcing side plate 4 provided on the rearmost side thereof.

As illustrated in FIG. 2, the reinforcing side plate 1 has a substantially rectangular plate shape. The reinforcing side plate 1 is provided with a first inflow pipe 5, a first outflow pipe 6, a second inflow pipe 7, and a second outflow pipe 8 at the four respective corners of the substantially rectangular shape thereof.

As illustrated in FIGS. 3 and 4, each of the heat transfer plates 2 and 3 has a substantially rectangular plate shape, in the same way as the reinforcing side plate 1, and has a first inlet 9, a first outlet 10, a second inlet 11, and a second outlet 12 at the four respective corners thereof. Furthermore, the heat transfer plates 2 and 3 have respective wavy portions 15 and 16 waving in the plate stacking direction. The wavy portions 15 and 16 each have a substantially V-formed shape when seen in the stacking direction, with two ends of the V shape residing on two respective sides, in a short-side direction, of a corresponding one of the heat transfer plates 2 and 3 and with a folding point of the V shape residing at a position of the corresponding one of the heat transfer plates 2 and 3 that is displaced in a long-side direction from the two ends. Note that the substantially V-formed shape of the wavy portion 15 provided in the heat transfer plate 2 and the substantially V-formed shape of the wavy portion 16 provided in the heat transfer plate 3 are inverse to each other.

As illustrated in FIG. 5, the reinforcing side plate 4 has a substantially rectangular plate shape, as with the reinforcing side plate 1 and other plates. The reinforcing side plate 4 is provided with none of the first inflow pipe 5, the first outflow pipe 6, the second inflow pipe 7, and the second outflow pipe 8. In FIG. 5, positions of the reinforcing side plate 4 that correspond to the first inflow pipe 5, the first outflow pipe 6, the second inflow pipe 7, and the second outflow pipe 8 are represented by broken lines. This does not mean that the reinforcing side plate 4 is provided with them.

As illustrated in FIG. 6, when the heat transfer plate 2 and the heat transfer plate 3 are stacked, the wavy portions 15 and 16 having the respective substantially V-formed shapes that is oriented differently from each other meet each other, whereby a passage that produces a complex flow is provided between the heat transfer plate 2 and the heat transfer plate 3.

As illustrated in FIG. 7, the heat transfer plates 2 and 3 are stacked such that the respective first inlets 9 meet one another, the respective first outlets 10 meet one another, the respective second inlets 11 meet one another, and the respective second outlets 12 meet one another. The reinforcing side plate 1 and one of the heat transfer plates 2 are stacked such that the first inflow pipe 5 and the first inlet 9 meet each other, the first outflow pipe 6 and the first outlet 10 meet each other, the second inflow pipe 7 and the second inlet 11 meet each other, and the second outflow pipe 8 and the second outlet 12 meet each other. The heat transfer plates 2 and 3 and the reinforcing side plates 1 and 4 are stacked such that the outer circumferential edges thereof meet one another and are bonded to one another by brazing. The heat transfer plates 2 and 3 are bonded not only at the outer circumferential edges thereof but also at positions where, when seen in the stacking direction, bottom parts of the wavy portion of one of each pair of heat transfer plates that is on the upper side (front side) and top parts of the wavy portion of the other heat transfer plate that is on the lower side (rear side) meet each other.

In this manner, a first passage 13 through which a first fluid (such as water) having flowed from the first inflow pipe 5 is discharged out of the first outflow pipe 6 is provided between the back side of each heat transfer plate 2 and the front side of a corresponding one of the heat transfer plates 3. Likewise, a second passage 14 through which a second fluid (such as a refrigerant) having flowed from the second inflow pipe 7 is discharged into the second outflow pipe 8 is provided between the back side of each heat transfer plate 3 and the front side of a corresponding one of the heat transfer plates 2.

The first fluid having flowed from the outside into the first inflow pipe 5 flows through a passage hole formed by the first inlets 9 of the respective heat transfer plates 2 and 3 that meet one another, and flows into the first passage 13. The first fluid having flowed into the first passage 13 flows in the long-side direction while gradually spreading in the short-side direction and flows out of the first outlet 10. The first fluid having flowed into the first outlet 10 flows through a passage hole provided by the first outlets 10 that meet one another, and is discharged from the first outflow pipe 6 to the outside.

Likewise, the second fluid having flowed from the outside into the second inflow pipe 7 flows through a passage hole provided by the second inlets 11 of the respective heat transfer plates 2 and 3 that meet one another, and flows into the second passage 14. The second fluid having flowed into the second passage 14 flows in the long-side direction while gradually spreading in the short-side direction and flows out of the second outlet 12. The second fluid having flowed into the second outlet 12 flows through a passage hole provided by the second outlets 12 that meet one another, and is discharged from the second outflow pipe 8 to the outside.

The first fluid that flows through the first passage 13 and the second fluid that flows through the second passage 14 exchange heat therebetween via the heat transfer plates 2 and 3 when flowing through areas where the wavy portions 15 and 16 are provided. The areas of the first passage 13 and the second passage 14 where the respective wavy portions 15 and 16 are provided are referred to as heat-exchanging passages 17 (see FIGS. 3, 4, and 6).

Features of the plate heat exchanger 30 according to Embodiment 1 will now be described.

Figure 8:
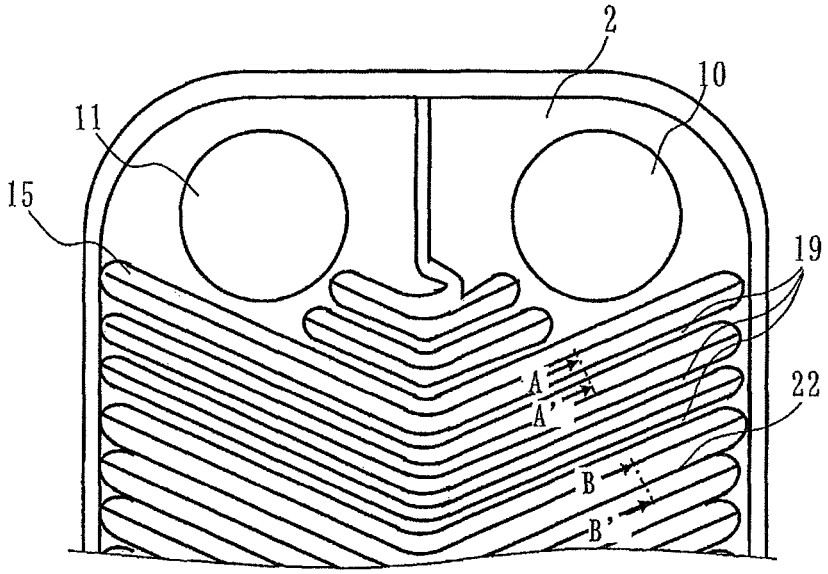
FIG. 8 is a diagram of the heat transfer plate 2 according to Embodiment 1.
Figure 9:
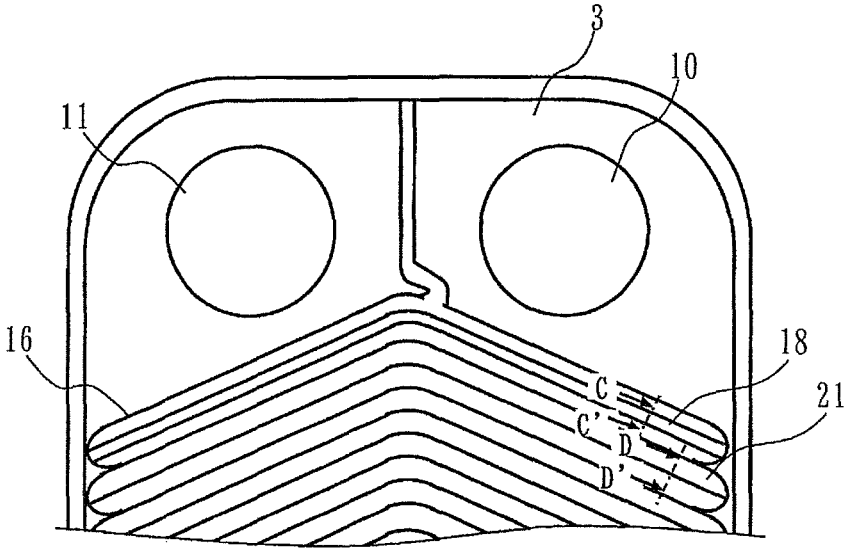
FIG. 9 is a diagram of the heat transfer plate 3 according to Embodiment 1.
Figure 10:
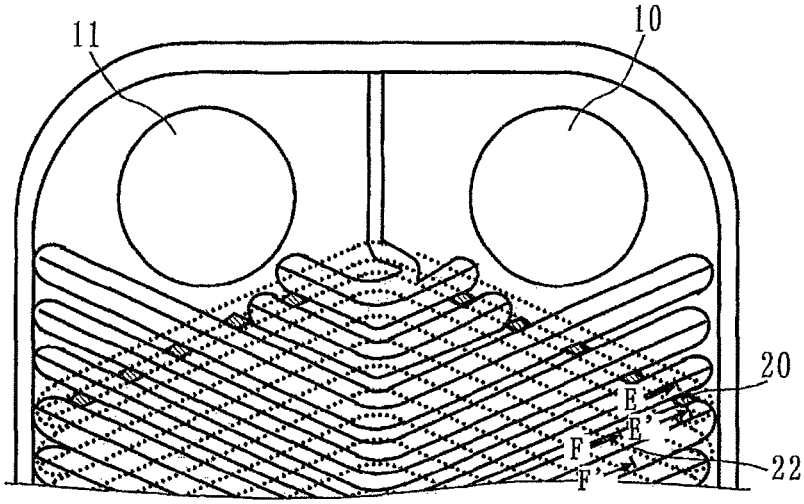
FIG. 10 is a diagram illustrating a state where the heat transfer plate 2 and the heat transfer plate 3 according to Embodiment 1 are stacked.
Figure 11:
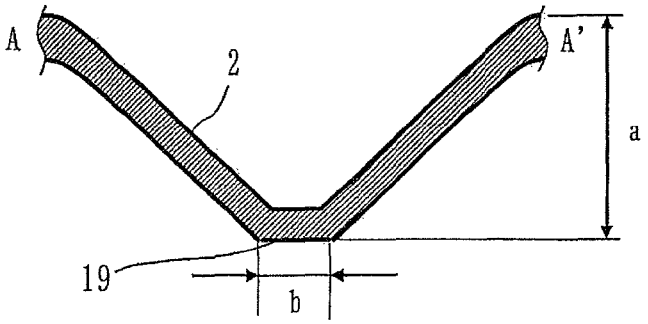
FIG. 11 is a sectional view taken along line A-A' illustrated in FIG. 8.
Figure 12:
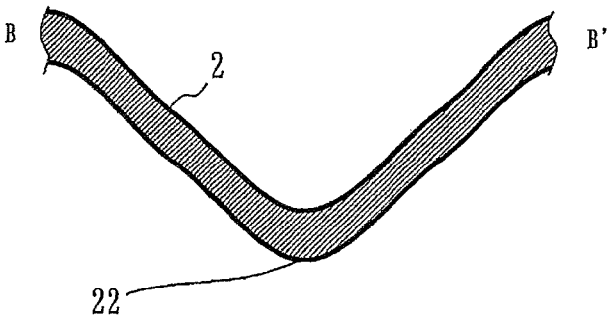
FIG. 12 is a sectional view taken along line B-B' illustrated in FIG. 8.
Figure 13:
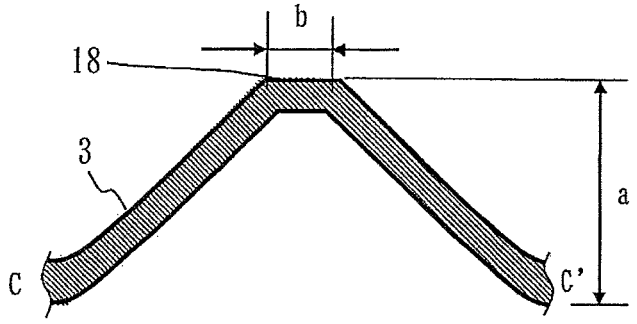
FIG. 13 is a sectional view taken along line C-C' illustrated in FIG. 9.
Figure 14:
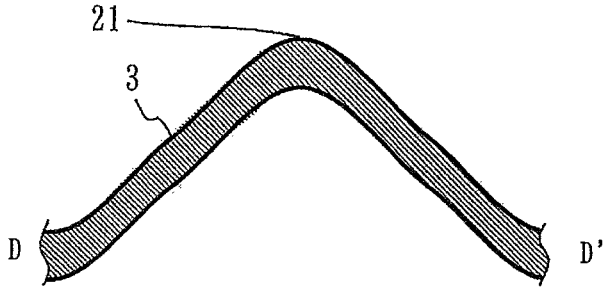
FIG. 14 is a sectional view taken along line D-D' illustrated in FIG. 9.
Figure 15:
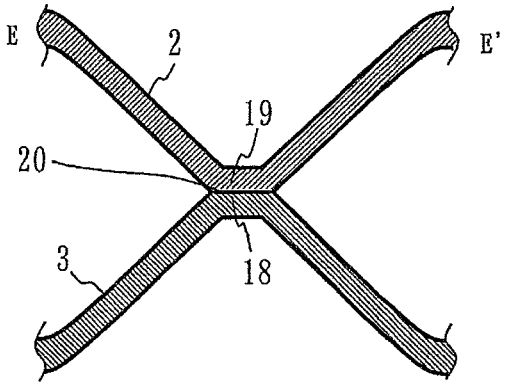
FIG. 15 is a sectional view taken along line E-E' illustrated in FIG. 10.
Figure 16:
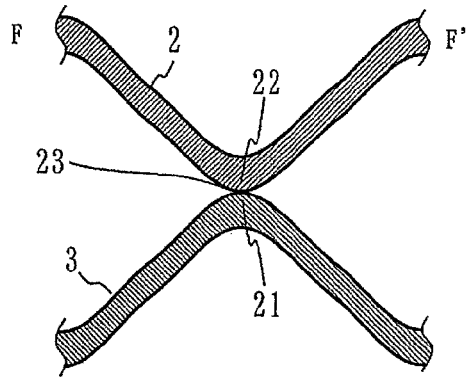
FIG. 16 is a sectional view taken along line F-F' illustrated in FIG. 10.

FIG. 8 is a diagram of the heat transfer plate 2 according to Embodiment 1. FIG. 9 is a diagram of the heat transfer plate 3 according to Embodiment 1. FIG. 10 is a diagram illustrating a state where the heat transfer plate 2 and the heat transfer plate 3 according to Embodiment 1 are stacked. FIG. 11 is a sectional view taken along line A-A' illustrated in FIG. 8. FIG. 12 is a sectional view taken along line B-B' illustrated in FIG. 8. FIG. 13 is a sectional view taken along line C-C' illustrated in FIG. 9. FIG. 14 is a sectional view taken along line D-D' illustrated in FIG. 9. FIG. 15 is a sectional view taken along line E-E' illustrated in FIG. 10. FIG. 16 is a sectional view taken along line F-F' illustrated in FIG. 10.

As illustrated in FIGS. 9 and 13, among the top parts of the wavy portion 16 provided in the heat transfer plate 3, an adjacent top part 18 as one top part (the first wave) of the wavy portion 16 that is adjacent to the first outlet 10 and the second inlet 11 has a planar (substantially flat) shape. As illustrated in FIGS. 8 and 11, among the bottom parts of the wavy portion 15 provided in the heat transfer plate 2, bonded bottom parts 19 as some bottom parts that are bonded to the adjacent top part 18 each have a planar shape.

Hence, as illustrated in FIGS. 10 and 15, overlapping parts 20 (hatched areas in FIG. 10) where the adjacent top part 18 and the bonded bottom parts 19 overlap each other are each provided in the form of a surface, not a point. Accordingly, a large bonded area where the adjacent top part 18 and the bonded bottom parts 19 are bonded to each other by brazing is provided, and high bonding strength is provided. That is, high bonding strength is provided between the first wave that is on the side of the heat transfer plate 3, the side having the first outlet 10 and the second inlet 11 and the heat transfer plate 2.

In general, a wavy portion of a plate is formed by presswork. Regions near the inlets and the outlets of the wavy portions 15 and 16 are positioned far from a crank shaft of a press machine and are therefore more likely to have errors in wave height (a length "a" in FIGS. 11 and 13) than regions of the wavy portions 15 and 16 that are in central areas of the heat transfer plates 2 and 3. If the length "a" corresponding to the wave height is smaller than a design value, gaps are provided at positions between the heat transfer plates 2 and 3 where the heat transfer plates 2 and 3 are intended to be closely in contact with each other. Consequently, bonding by brazing may be unsuccessful.

However, since the adjacent top part 18 and the bonded bottom parts 19 each have planar shapes, bonding by brazing is successful even if there are any gaps between the adjacent top part 18 and the bonded bottom parts 19.

Meanwhile, as illustrated in FIGS. 9 and 14, among the top parts of the wavy portion 16 provided in the heat transfer plate 3, other top parts 21 as top parts excluding the adjacent top part 18 each have a convex shape. Likewise, as illustrated in FIGS. 8 and 12, among bottom parts of the wavy portion 15 provided in the heat transfer plate 2, other bottom parts 22 as bottom parts excluding the bonded bottom parts 19 each have a convex shape.

Hence, as illustrated in FIG. 16, each of overlapping parts 23 where the other top parts 21 and the respective other bottom parts 22 overlap each other is provided in the form of a point. Accordingly, the area where each of the other top parts 21 and a corresponding one of the other bottom parts 22 are bonded to each other by brazing is small. Therefore, the effective area of heat exchange in each of the heat-exchanging passages 17 is not small. Moreover, pressure loss is reduced.

The above description only concerns a side of each of the heat transfer plates 2 and 3 on which the first outlet 10 and the second inlet 11 are provided. The other side on which the first inlet 9 and the second outlet 12 are provided may have the same configuration as the above.

That is, among the top parts of the wavy portion 16 provided in the heat transfer plate 3, one top part (the first wave) of the wavy portion 16 that is adjacent to the first inlet 9 and the second outlet 12 may have a planar shape. Furthermore, some of the bottom parts of the wavy portion 15 provided in the heat transfer plate 2 that are bonded to the top part (the first wave) of the wavy portion 16 provided in the heat transfer plate 3 and being adjacent to the first inlet 9 and the second outlet 12 may each have a planar shape. Thus, as with the configuration on the side having the first outlet 10 and the second inlet 11, high bonding strength is provided between the first wave provided on the side of the heat transfer plate 3 having the first inlet 9 and the second outlet 12 and the heat transfer plate 2.

The above description only concerns the configuration between the rear side of the heat transfer plate 2 and the front side of the heat transfer plate 3. Alternatively, however, the configuration between the rear side of the heat transfer plate 3 and the front side of the heat transfer plate 2 may be the same as above.

That is, among the top parts of the wavy portion 15 provided in the heat transfer plate 2, one top part of the wavy portion 15 (the first wave) that is adjacent to the first outlet 10 and the second inlet 11 and one top part of the wavy portion 15 (the first wave) that is adjacent to the first inlet 9 and the second outlet 12 may each have a planar shape. Furthermore, some of the bottom parts of the wavy portion 16 provided in the heat transfer plate 3 that are bonded to the top part (the first wave) of the wavy portion 15 provided in the heat transfer plate 2 and being adjacent to the first outlet 10 and the second inlet 11 and to the top part (the first wave) of the wavy portion 15 provided in the heat transfer plate 2 and being adjacent to the first inlet 9 and the second outlet 12 may each have a planar shape. Thus, in a configuration between the rear side of the heat transfer plate 3 and the front side of the heat transfer plate 2 also, high bonding strength is provided between the first wave of the heat transfer plate 2 and the heat transfer plate 3, as with the configuration between the rear side of the heat transfer plate 2 and the front side of the heat transfer plate 3.

In the above description, only the top part of the first wave that is adjacent to the inlet and the outlet has a planar shape. Alternatively, the top parts of two or more waves adjacent to the inlet and the outlet may each have a planar shape. Moreover, the bottom parts of adjacent ones of the heat transfer plates 2 and 3 that are bonded to the planar top parts thereof may each have a planar shape.

As described above, in the plate heat exchanger 30 according to Embodiment 1, high bonding strength is provided between the regions of the wavy portions 15 and 16 that are adjacent to the inlets and the outlets. Therefore, the plate heat exchanger 30 has high compressive strength.

Even if the length "a" corresponding to the wave height of the regions of the wavy portions 15 and 16 that are adjacent to the inlets and the outlets is small, bonding by brazing is possible. Hence, the plate heat exchanger 30 having stable strength is provided even in mass production.

If the plate heat exchanger 30 has high strength, the reinforcing side plates 1 and 4 and the heat transfer plates 2 and 3 can be made thicker. Consequently, the material cost of the plate heat exchanger 30 is reduced.

Furthermore, if the plate heat exchanger 30 has high strength and thus has high reliability, the occurrence of refrigerant leakage is suppressed. Therefore, CO2, which is a high-pressure refrigerant, is available. Moreover, a flammable refrigerant such as hydrocarbon or a low-GWP (global warming potential) refrigerant is also available.

Embodiment 2

Embodiment 1 has been described about a case where the adjacent top part 18 and the bonded bottom parts 19 each have a planar shape. Embodiment 2 will now be described about a case where the adjacent top part 18 and the bonded bottom parts 19 each have a planar surface with a predetermined width.

The width of the adjacent top part 18 or the bonded bottom parts 19 corresponds to a width b illustrated in FIGS. 11 and 13. The width b corresponds to the width of each top part or bottom part in a direction perpendicular to the ridges of a corresponding one of the wavy portions 15 and 16.

The width b is desirably 1 millimeter or larger and 2 millimeters or smaller. If the width b is 1 millimeter or larger and 2 millimeters or smaller, high bonding strength is provided while the increase in pressure loss is prevented.

If the width b is smaller than 1 millimeter, the bonded area may be too small, resulting in low bonding strength. If, for example, the heat transfer plates 2 and 3 are formed with the lowest allowable press accuracy and a gap of about 0.1 millimeters is produced at any of the overlapping parts 20 between the heat transfer plates 2 and 3, bonding by brazing may be unsuccessful.

In contrast, if the width b is larger than 2 millimeters, the brazed area may be too large, increasing the pressure loss. Moreover, depending on situations, the brazed area may be so large that solder in any of the overlapping parts may be connected to solder in another overlapping part adjacent thereto, thereby blocking the passage.

The width b may be adjusted within the above range so that a brazed area corresponding to a required bonding strength is provided.

Embodiment 3

Embodiment 2 has been described about a case where the adjacent top part 18 and the bonded bottom parts 19 each have a planar surface with a predetermined width. Embodiment 3 will now be described about a case where the adjacent top part 18 and the bonded bottom parts 19 each have a gently curved surface that is nearly planar.

Figure 17:
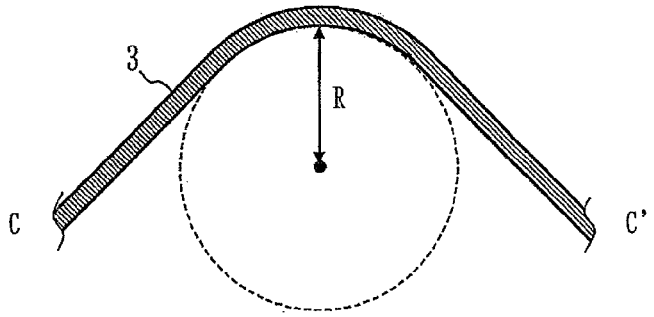
FIG. 17 is a diagram illustrating an adjacent top part 18 according to Embodiment 3.
Figure 18:
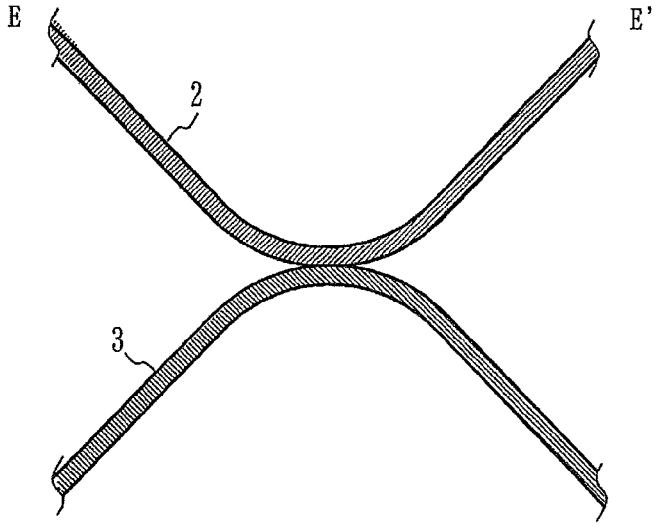
FIG. 18 is a diagram illustrating an overlapping part 20 according to Embodiment 3.

FIG. 17 is a diagram illustrating an adjacent top part 18 according to Embodiment 3 and is a sectional view taken along line C-C' illustrated in FIG. 9. FIG. 18 is a diagram illustrating an overlapping part 20 according to Embodiment 3 and is a sectional view taken along line E-E' illustrated in FIG. 10.

As illustrated in FIG. 17, the adjacent top part 18 has a curved surface with a bend radius R of 2 millimeters or larger and 10 millimeters or smaller. Likewise, a bonded bottom part 19 has a curved surface with a bend radius R of 2 millimeters or larger and 10 millimeters or smaller. With the adjacent top part 18 and the bonded bottom part 19 each having a curved surface with a bend radius R of 2 millimeters or larger and 10 millimeters or smaller, bonding strength is increased while the increase in pressure loss is prevented.

If the bend radius R is smaller than 2 millimeters, the bonded area may be too small, resulting in low bonding strength. If, for example, the heat transfer plates 2 and 3 are formed with the lowest allowable press accuracy and a gap of about 0.1 millimeters is produced at any of the overlapping parts 20 between the heat transfer plates 2 and 3, bonding by brazing may be unsuccessful.

In contrast, if the bend radius R is larger than 10 millimeters, the brazed area may be too large, increasing the pressure loss. Moreover, depending on situations, the brazed area may be so large that solder in any of the overlapping parts may be connected to solder in another overlapping part adjacent thereto, thereby blocking the passage.

The bend radius R may be adjusted within the above range so that a brazed area corresponding to a required bonding strength is provided.

Embodiment 4

Embodiments 1 to 3 have been described about a case where the adjacent top part 18 and the bonded bottom parts 19 each have a planar shape. Embodiment 4 will now be described about a case where the adjacent top part 18 and each of the bonded bottom parts 19 have concave and convex shapes, respectively, that fit each other.

Figure 19:
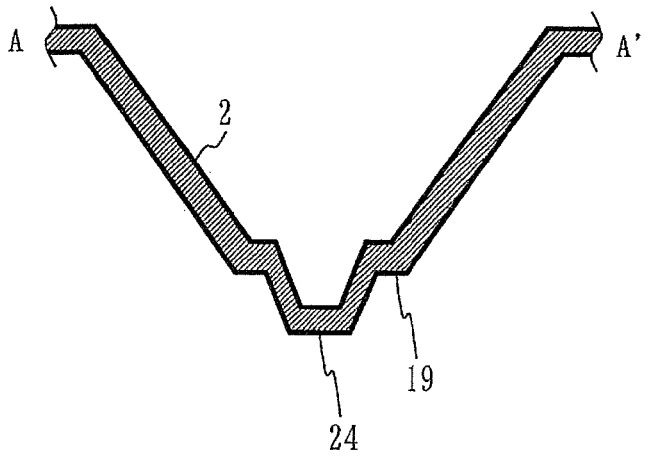
FIG. 19 is a diagram illustrating a bonded bottom part 19 according to Embodiment 4.
Figure 20:
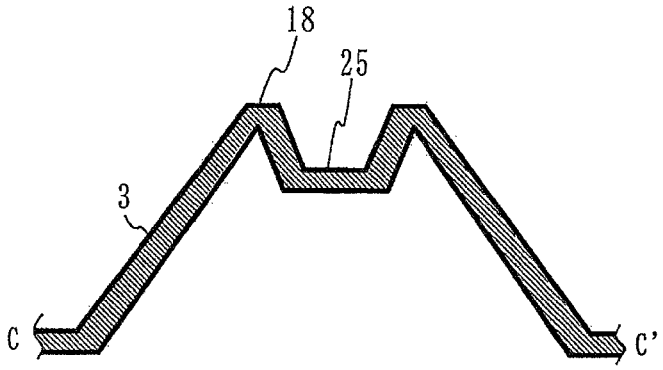
FIG. 20 is a diagram illustrating an adjacent top part 18 according to Embodiment 4.
Figure 21:
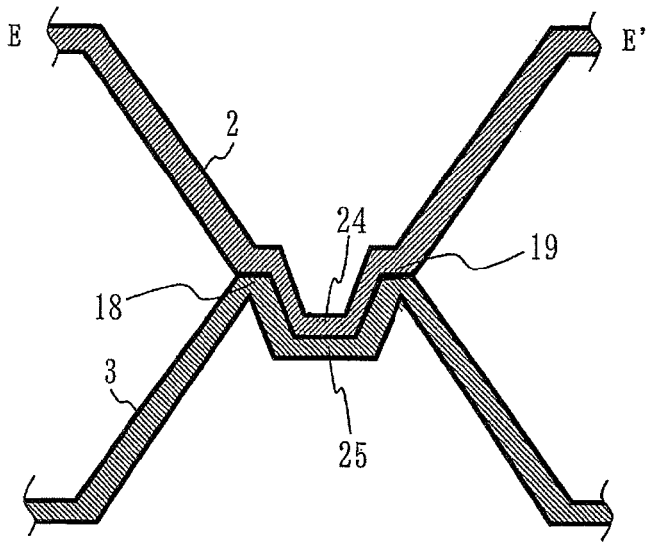
FIG. 21 is a diagram illustrating an overlapping part 20 according to Embodiment 4.

FIG. 19 is a diagram illustrating a bonded bottom part 19 according to Embodiment 4 and is a sectional view taken along line A-A' illustrated in FIG. 8. FIG. 20 is a diagram illustrating an adjacent top part 18 according to Embodiment 4 and is a sectional view taken along line C-C' illustrated in FIG. 9. FIG. 21 is a diagram illustrating an overlapping part 20 according to Embodiment 4 and is a sectional view taken along line E-E' illustrated in FIG. 10.

As illustrated in FIGS. 19 and 20, the bonded bottom part 19 has a convex portion 24, and the adjacent top part 18 has a concave portion 25. In a state where the heat transfer plates 2 and 3 are stacked, the convex portion 24 and the concave portion 25 fit each other as illustrated in FIG. 21.

Since the adjacent top part 18 and the bonded bottom part 19 have a convexity and a concavity such as the convex portion 24 and the concave portion 25, respectively, the bonded area obtained when the heat transfer plates 2 and 3 are stacked is large and bonding strength is therefore high.

Figure 22:
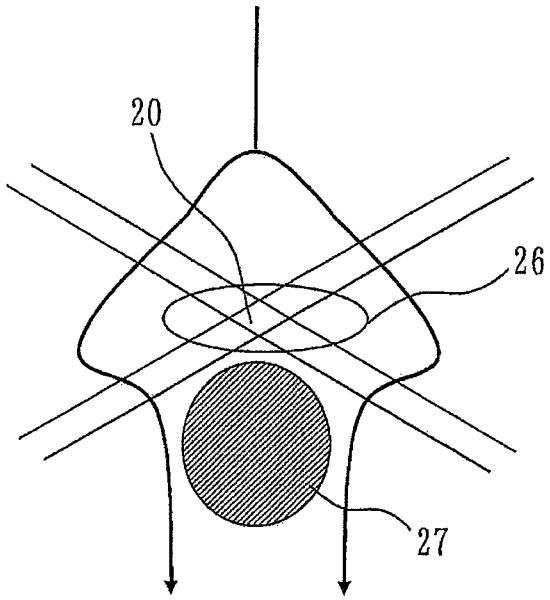
FIG. 22 is a diagram illustrating an overlapping part 20 in a case where neither concavity nor convexity is provided.
Figure 23:
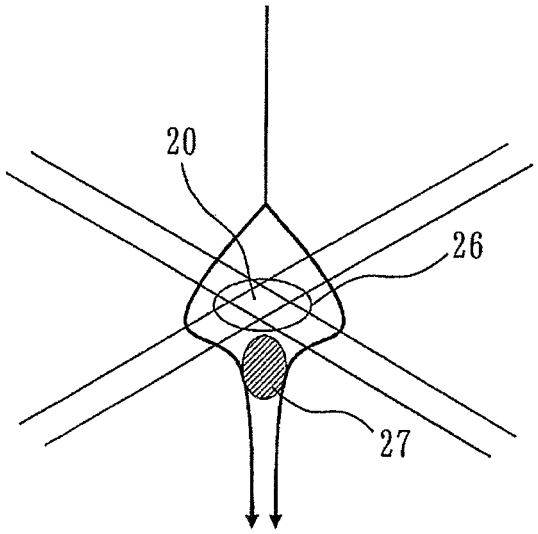
FIG. 23 is a diagram illustrating an overlapping part 20 in a case where a concavity and a convexity are provided.

FIG. 22 is a diagram illustrating an overlapping part 20 in a case where neither a concavity nor a convexity is provided. FIG. 23 is a diagram illustrating an overlapping part 20 in a case where a concavity and a convexity are provided.

As illustrated in FIG. 22, in the case where neither a concavity nor a convexity is provided, a solder material 26 spreads widely in the overlapping part 20, and a no-flow area 27 where the fluid does not flow toward the downstream side occurs. Therefore, pressure loss increases. In contrast, as illustrated in FIG. 23, in the case where a concavity and a convexity are provided, the solder material 26 spreads between the concavity and the convexity in the overlapping part 20. Therefore, the area where the solder material 26 spreads is small. Accordingly, the no-flow area 27 occurring because of the presence of the solder material 26 is small. Hence, the increase in pressure loss is prevented. Furthermore, since the no-flow area 27 is small, the effective area of heat exchange increases. Consequently, high heat exchangeability is provided.

With the above advantageous effects, the number of heat transfer plates 2 and 3 to be included in the plate heat exchanger 30 in accordance with the required capacity can be reduced. Moreover, residual matter such as refrigerating machine oil or dust is prevented from staying in the plate heat exchanger 30. Therefore, the reliability of the plate heat exchanger 30 is increased while the material cost of the plate heat exchanger 30 is reduced.

The above description concerns a case where the adjacent top part 18 and the bonded bottom part 19 have a concavity and a convexity, respectively. That is, in the case described above, the first waves included in the respective wavy portions 15 and 16 and each being adjacent to the inlet and the outlet and waves bonded to the foregoing waves each have a top part or a bottom part having a concavity or a convexity. Alternatively, the top parts and the bottom parts of all waves included in the wavy portions 15 and 16 may each have a concavity or a convexity.

Furthermore, the concavity and the convexity may be provided over the entirety of the adjacent top part 18 and the entirety of the bonded bottom part 19, or only in regions of the adjacent top part 18 and regions of the bonded bottom part 19 residing in the overlapping part 20.

Embodiment 5

Embodiments 1 to 3 have been described about a case where the adjacent top part 18 and the bonded bottom part 19 each have a planar shape. Embodiment 5 will now be described about a case where the wave heights of the adjacent top part 18 and the bonded bottom part 19 are larger than the wave heights of the other waves.

Figure 24:
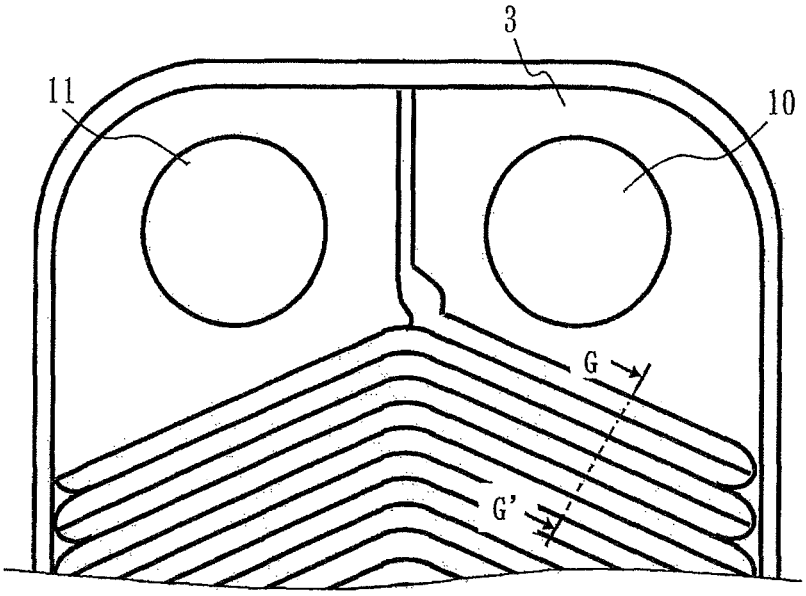
FIG. 24 is a diagram of a heat transfer plate 3 according to Embodiment 5.
Figure 25:
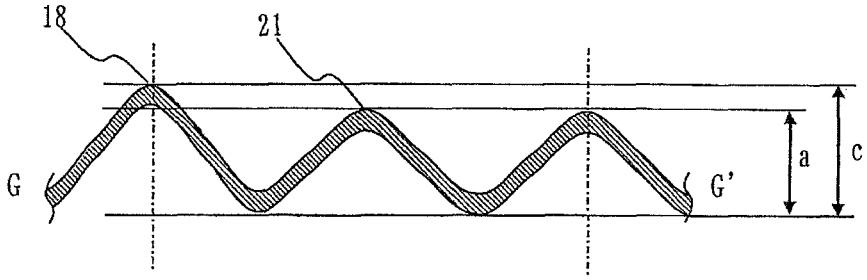
FIG. 25 is a sectional view taken along line G-G' illustrated in FIG. 24.

FIG. 24 is a diagram of a heat transfer plate 3 according to Embodiment 5. FIG. 25 is a sectional view taken along line G-G' illustrated in FIG. 24.

As illustrated in FIG. 25, the wave height (a length c in FIG. 25) of the adjacent top part 18 is larger than the wave height (a length "a" in FIG. 25) of each of the other top parts 21. Although not illustrated, the wave height of the bonded bottom part 19 is also larger than the wave height of each of the other bottom parts 22.

Since the wave heights of the adjacent top part 18 and the bonded bottom part 19 are larger than the wave heights of the other waves, the adjacent top part 18 and the bonded bottom part 19 are squashed and are depressed by a load applied in brazing, thereby having planar shapes. Thus, the same effects as those provided in Embodiment 1 are provided.

To form the plate heat exchanger 30 according to Embodiment 1, the adjacent top part 18 and the bonded bottom part 19 need to be processed in such a manner as to have planar shapes. In contrast, to form the plate heat exchanger 30 according to Embodiment 5, it is only necessary to increase the wave heights of the adjacent top part 18 and the bonded bottom part 19. That is, the plate heat exchanger 30 according to Embodiment 5 is obtained by simply changing the dimensions of portions of the mold that determine the wave heights of the adjacent top part 18 and the bonded bottom part 19. Therefore, the plate heat exchanger 30 according to Embodiment 5 is manufacturable at a lower cost than the plate heat exchanger 30 according to Embodiment 1.

Embodiment 6

Embodiments 1 to 5 have been described about a case where the shapes of the adjacent top part 18 and the bonded bottom part 19 are changed. Embodiment 6 will now be described about a case where the angle of a wave having the adjacent top part 18 or the bonded bottom part 19 is changed.

Figure 26:
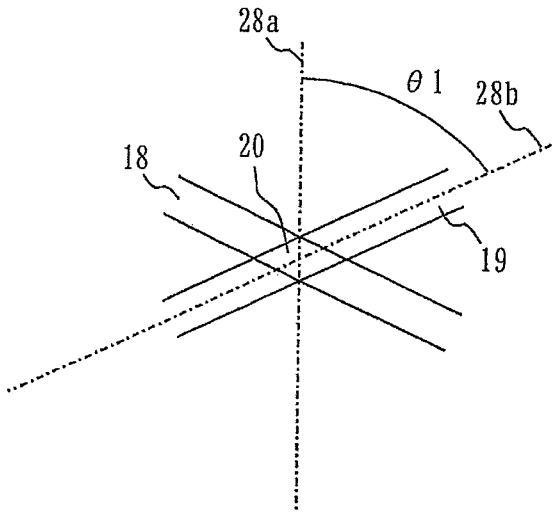
FIG. 26 is a diagram illustrating a wave angle of a wave having neither the adjacent top part 18 nor the bonded bottom part 19.
Figure 27:
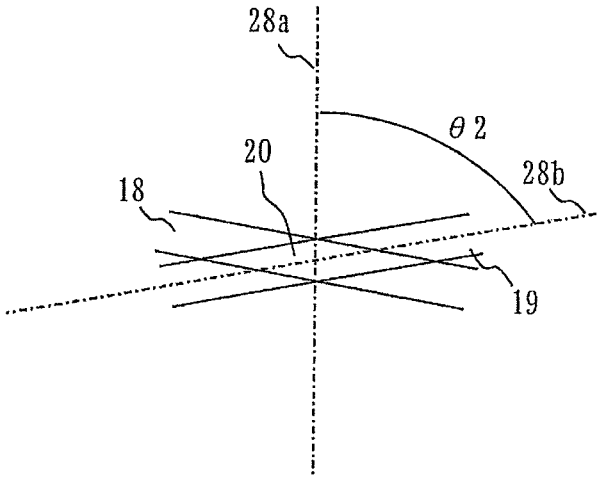
FIG. 27 is a diagram illustrating a wave angle of a wave having the adjacent top part 18 or the bonded bottom part 19.

FIG. 26 is a diagram illustrating a wave angle of a wave having neither the adjacent top part 18 nor the bonded bottom part 19. FIG. 27 is a diagram illustrating a wave angle of a wave having the adjacent top part 18 or the bonded bottom part 19.

The wave angle is an angle formed between a line 28*a* that is parallel to the long side of each of the heat transfer plates 2 and 3 and a ridge 28*b* of each wave. As illustrated in FIGS. 26 and 27, a wave angle θ1 of the wave having neither the adjacent top part 18 nor the bonded bottom part 19 is, for example, 65 degrees, whereas a wave angle θ2 of the wave having the adjacent top part 18 or the bonded bottom part 19 is, for example, 75 degrees. That is, the wave angle θ2 is larger than the wave angle θ1. In other words, the folding angle of each of V-shaped waves is larger for the wave having the adjacent top part 18 or the bonded bottom part 19 than for the wave having neither the adjacent top part 18 nor the bonded bottom part 19.

As illustrated in FIGS. 26 and 27, as the wave angle is increased, the area of the overlapping part 20 increases. That is, increasing the wave angle of the wave having the adjacent top part 18 or the bonded bottom part 19 increases the bonded area and thus the bonding strength.

Figure 28:
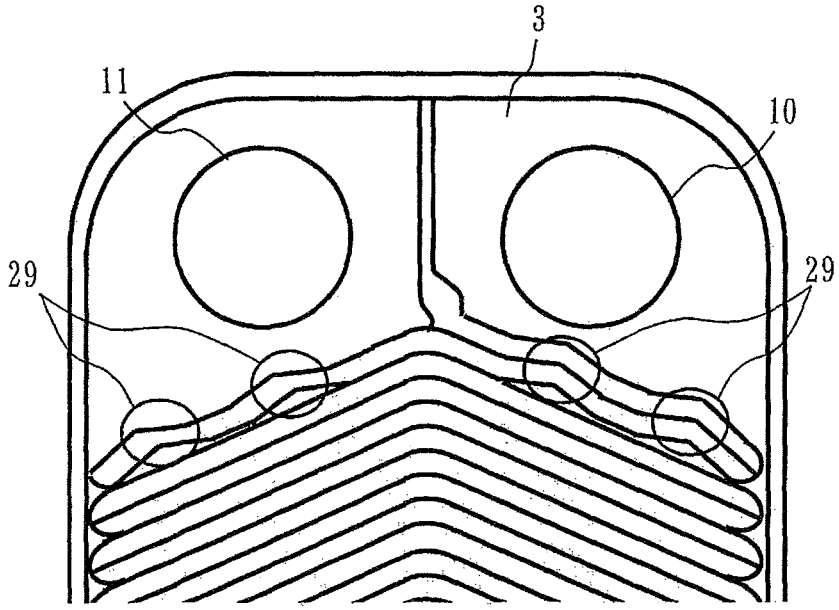
FIG. 28 is a diagram illustrating an exemplary case where the wave angle of a wave having the adjacent top part 18 or the bonded bottom part 19 is increased in some regions.

FIG. 28 is a diagram illustrating an exemplary case where the wave angle of a wave having the adjacent top part 18 or the bonded bottom part 19 is increased in some regions.

As illustrated in FIG. 28, bent portions 29 are provided in which some regions of a wave having the adjacent top part 18 or the bonded bottom part 19 are bent in the long-side direction. Thus, the wave angle in some regions of the wave having the adjacent top part 18 or the bonded bottom part 19 is increased. In such a case where the wave angle is increased in some regions, the bonded area and the bonding strength in those regions also increase.

Embodiment 7

Embodiment 7 will now be described about an exemplary circuit configuration of a heat pump apparatus 100 including the plate heat exchanger 30.

In the heat pump apparatus 100, a refrigerant such as CO2, R410A, HC, or the like is used. Some refrigerants, such as CO2, have their supercritical ranges on the high-pressure side. Herein, an exemplary case where R410A is used as a refrigerant will be described.

Figure 29:
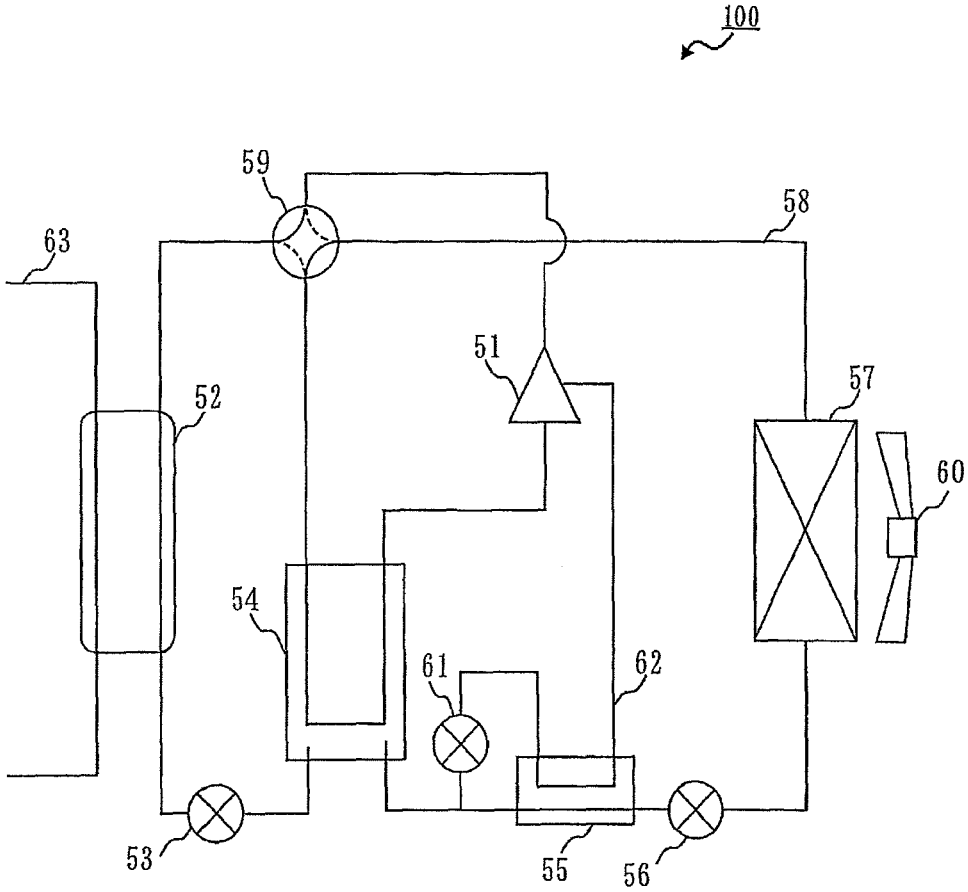
FIG. 29 is a circuit diagram of a heat pump apparatus 100 according to Embodiment 7.

FIG. 29 is a circuit diagram of the heat pump apparatus 100 according to Embodiment 7.

Figure 30:
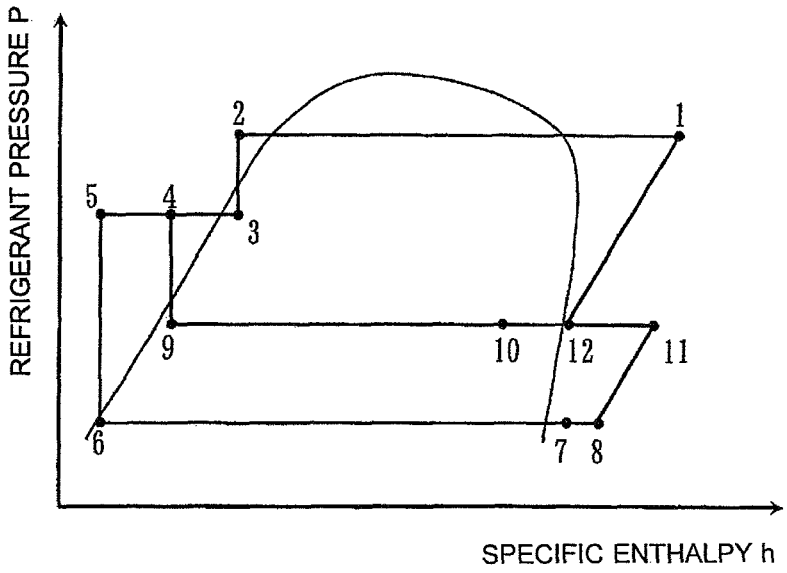
FIG. 30 is a Mollier chart illustrating the state of a refrigerant in the heat pump apparatus 100 illustrated in FIG. 29.

FIG. 30 is a Mollier chart illustrating the state of the refrigerant in the heat pump apparatus 100 illustrated in FIG. 29. In FIG. 30, the horizontal axis represents specific enthalpy, and the vertical axis represents refrigerant pressure.

The heat pump apparatus 100 includes a main refrigerant circuit 58 through which the refrigerant circulates. The main refrigerant circuit 58 includes a compressor 51, a heat exchanger 52, an expansion mechanism 53, a receiver 54, an internal heat exchanger 55, an expansion mechanism 56, and a heat exchanger 57 that are connected sequentially by pipes. In the main refrigerant circuit 58, a four-way valve 59 is provided on the discharge side of the compressor 51 and enables switching of the direction of refrigerant circulation. Furthermore, a fan 60 is provided near the heat exchanger 57. The heat exchanger 52 corresponds to the plate heat exchanger 30 according to any of the embodiments described above.

The heat pump apparatus 100 further includes an injection circuit 62 that connects a point between the receiver 54 and the internal heat exchanger 55 and an injection pipe of the compressor 51 by pipes. In the injection circuit 62, an expansion mechanism 61 and the internal heat exchanger 55 are connected sequentially.

The heat exchanger 52 is connected to a water circuit 63 through which water circulates. The water circuit 63 is connected to an apparatus that uses water, such as a water heater, a radiating apparatus as a radiator or for floor heating, or the like.

A heating operation performed by the heat pump apparatus 100 will first be described. In the heating operation, the four-way valve 59 is set as illustrated by the solid lines. The heating operation referred to herein includes heating for air conditioning and water heating for making hot water by giving heat to water.

A gas-phase refrigerant (point 1 in FIG. 30) having a high temperature and a high pressure in the compressor 51 is discharged from the compressor 51 and undergoes heat exchange in the heat exchanger 52 functioning as a condenser and a radiator, whereby the gas-phase refrigerant is liquefied (point 2 in FIG. 30). In this step, heat that has been transferred from the refrigerant heats the water circulating through the water circuit 63. The heated water is used for air heating or water heating.

The liquid-phase refrigerant obtained through the liquefaction in the heat exchanger 52 is subjected to pressure reduction in the expansion mechanism 53 and falls into a two-phase gas-liquid state (point 3 in FIG. 30). The two-phase gas-liquid refrigerant obtained in the expansion mechanism 53 exchanges heat, in the receiver 54, with a refrigerant that is sucked into the compressor 51, whereby the two-phase gas-liquid refrigerant is cooled and liquefied (point 4 in FIG. 30). The liquid-phase refrigerant obtained through the liquefaction in the receiver 54 splits and flows into the main refrigerant circuit 58 and the injection circuit 62.

The liquid-phase refrigerant flowing through the main refrigerant circuit 58 exchanges heat, in the internal heat exchanger 55, with a two-phase gas-liquid refrigerant obtained through the pressure reduction in the expansion mechanism 61 and flowing through the injection circuit 62, whereby the liquid-phase refrigerant is further cooled (point 5 in FIG. 30). The liquid-phase refrigerant having been cooled in the internal heat exchanger 55 is subjected to pressure reduction in the expansion mechanism 56 and falls into a two-phase gas-liquid state (point 6 in FIG. 30). The two-phase gas-liquid refrigerant obtained in the expansion mechanism 56 exchanges heat with the outside air in the heat exchanger 57 functioning as an evaporator and is thus heated (point 7 in FIG. 30). The refrigerant thus heated in the heat exchanger 57 is further heated in the receiver 54 (point 8 in FIG. 30) and is sucked into the compressor 51.

Meanwhile, as described above, the refrigerant flowing through the injection circuit 62 is subjected to pressure reduction in the expansion mechanism 61 (point 9 in FIG. 30) and undergoes heat exchange in the internal heat exchanger 55 (point 10 in FIG. 30). The two-phase gas-liquid refrigerant (an injection refrigerant) obtained through the heat exchange in the internal heat exchanger 55 remains in the two-phase gas-liquid state and flows through the injection pipe of the compressor 51 into the compressor 51.

In the compressor 51, the refrigerant (point 8 in FIG. 30) having been sucked from the main refrigerant circuit 58 is compressed to an intermediate pressure and is heated (point 11 in FIG. 30). The refrigerant having been compressed to an intermediate pressure and having been heated (point 11 in FIG. 30) merges with the injection refrigerant (point 10 in FIG. 30), whereby the temperature drops (point 12 in FIG. 30). The refrigerant having a dropped temperature (point 12 in FIG. 30) is further compressed and heated to have a high temperature and a high pressure, and is then discharged (point 1 in FIG. 30).

In a case where an injection operation is not performed, the opening degree of the expansion mechanism 61 is set fully closed. That is, in a case where the injection operation is performed, the opening degree of the expansion mechanism 61 is larger than a predetermined opening degree. In contrast, in the case where the injection operation is not performed, the opening degree of the expansion mechanism 61 is made smaller than the predetermined opening degree. This prevents the refrigerant from flowing into the injection pipe of the compressor 51.

The opening degree of the expansion mechanism 61 is electronically controlled by a controller such as a microprocessor.

A cooling operation performed by the heat pump apparatus 100 will now be described. In the cooling operation, the four-way valve 59 is set as illustrated by the broken lines. The cooling operation referred to herein includes cooling for air conditioning, cooling for making cold water by receiving heat from water, refrigeration, and the like.

A gas-phase refrigerant (point 1 in FIG. 30) having a high temperature and a high pressure in the compressor 51 is discharged from the compressor 51 and undergoes heat exchange in the heat exchanger 57 functioning as a condenser and a radiator, whereby the gas-phase refrigerant is liquefied (point 2 in FIG. 30). The liquid-phase refrigerant obtained through the liquefaction in the heat exchanger 57 is subjected to pressure reduction in the expansion mechanism 56 and falls into a two-phase gas-liquid state (point 3 in FIG.

30). The two-phase gas-liquid refrigerant obtained in the expansion mechanism 56 undergoes heat exchange in the internal heat exchanger 55, thereby being cooled and liquefied (point 4 in FIG. 30). In the internal heat exchanger 55, the two-phase gas-liquid refrigerant obtained in the expansion mechanism 56 and another two-phase gas-liquid refrigerant (point 9 in FIG. 30) obtained through the pressure reduction, in the expansion mechanism 61, of the liquid-phase refrigerant having been liquefied in the internal heat exchanger 55 exchange heat therebetween. The liquid-phase refrigerant (point 4 in FIG. 30) having undergone heat exchange in the internal heat exchanger 55 splits and flows into the main refrigerant circuit 58 and the injection circuit 62.

The liquid-phase refrigerant flowing through the main refrigerant circuit 58 exchanges heat, in the receiver 54, with the refrigerant that is sucked into the compressor 51, whereby the liquid-phase refrigerant is further cooled (point 5 in FIG. 30). The liquid-phase refrigerant having been cooled in the receiver 54 is subjected to pressure reduction in the expansion mechanism 53 and falls into a two-phase gas-liquid state (point 6 in FIG. 30). The two-phase gas-liquid refrigerant obtained in the expansion mechanism 53 undergoes heat exchange in the heat exchanger 52 functioning as an evaporator, and is thus heated (point 7 in FIG. 30). In this step, since the refrigerant receives heat, the water circulating through the water circuit 63 is cooled and is used for cooling or refrigeration.

The refrigerant having been heated in the heat exchanger 52 is further heated in the receiver 54 (point 8 in FIG. 30) and is sucked into the compressor 51.

Meanwhile, as described above, the refrigerant flowing through the injection circuit 62 is subjected to pressure reduction in the expansion mechanism 61 (point 9 in FIG. 30) and undergoes heat exchange in the internal heat exchanger 55 (point 10 in FIG. 30). The two-phase gas-liquid refrigerant (injection refrigerant) obtained through heat exchange in the internal heat exchanger 55 remains in the two-phase gas-liquid state and flows into the injection pipe of the compressor 51.

The compressing operation in the compressor 51 is the same as that for the heating operation.

In the case where the injection operation is not performed, the opening degree of the expansion mechanism 61 is set fully closed as in the case of the heating operation so that the refrigerant does not flow into the injection pipe of the compressor 51.

REFERENCE SIGNS LIST

1 reinforcing side plate, 2 and 3 heat transfer plate, 4 reinforcing side plate, 5 first inflow pipe, 6 first outflow pipe, 7 second inflow pipe, 8 second outflow pipe, 9 first inlet, 10 first outlet, 11 second inlet, 12 second outlet, 13 first passage, 14 second passage, 15 and 16 wavy portion, 17 heat-exchanging passage, 18 adjacent top part, 19 bonded bottom part, 20 overlapping part, 21 other top part, 22 other bottom part, 23 overlapping part, 24 convex portion, 25 concave portion, 26 solder material, 27 no-flow area, 28 line parallel to long side, 29 bent portion, 30 plate heat exchanger, 51 compressor, 52 heat exchanger, 53 expansion mechanism, 54 receiver, 55 internal heat exchanger, 56 expansion mechanism, 57 heat exchanger, 58 main refrigerant circuit, 59 four-way valve, 60 fan, 61 expansion mechanism, 62 injection circuit, 100 heat pump apparatus

The invention claimed is:

1. A plate heat exchanger in which a plurality of plates each having an inlet and an outlet for a fluid are stacked, and a passage through which the fluid having flowed therein from the inlet flows toward the outlet is provided between adjacent plates, wherein each of the plates has a wavy portion provided between the inlet and the outlet and waving in a plate stacking direction, the wavy portion having a plurality of top parts and a plurality of bottom parts provided alternately from a side on which the inlet is provided toward a side on which the outlet is provided, wherein the wavy portions of the respective plates each have a V shape in the stacking direction, the V shapes are substantially evenly distributed in the wavy portions, wherein the adjacent plates are bonded to each other at regions thereof where the top parts of the V-shaped wavy portion provided in a lower one of the plates that is on a lower side in the stacking direction and the bottom parts of the V-shaped wavy portion provided in an upper one of the plates that is on an upper side overlap each other, wherein at least one of the top parts of the V-shaped wavy portion of the lower plate is an adjacent top part, and at least another one of the top parts of the V-shaped wavy portion is a top part other than the adjacent top part, wherein the adjacent top part is adjacent to at least one of the inlet and the outlet, and the adjacent top part has a planar shape, wherein an upper surface of the top part other than the adjacent top part has a convex shape protruding toward the upper side, wherein the bottom parts of the wavy portion of the upper plate include at least one bonded bottom part and at least one bottom part other than the bonded bottom part, wherein the bonded bottom part of the upper plate is bonded to the adjacent top part of the lower plate, and the bonded bottom part has a planar shape, wherein a lower surface of the bottom part other than the bonded bottom part has a convex shape protruding toward the lower side, and wherein a bonded area where the adjacent top part and the bonded bottom part are bonded is larger than a bonded area where the top part other than the adjacent top part and the bottom part other than the bonded bottom part are bonded.

2. The plate heat exchanger of claim 1, wherein the adjacent top part is a planar surface having a width of 1 millimeter or larger and 2 millimeters or smaller in a direction perpendicular to ridges of the wavy portion.

3. A plate heat exchanger in which a plurality of plates each having an inlet and an outlet for a fluid are stacked, and a passage through which the fluid having flowed therein from the inlet flows toward the outlet is provided between adjacent plates, wherein each of the plates has a wavy portion provided between the inlet and the outlet and waving in a plate stacking direction, the wavy portion having a plurality of top parts and a plurality of bottom parts provided alternately from a side on which the inlet is provided toward a side on which the outlet is provided, wherein the wavy portions of the respective plates each have a V shape in the stacking direction, the V shapes are substantially evenly distributed in the wavy portions, wherein the adjacent plates are bonded to each other at regions thereof where the top parts of the V-shaped wavy portion provided in a lower one of the plates that is on a lower side in the stacking direction and the bottom parts of the V-shaped wavy portion provided in an upper one of the plates that is on an upper side overlap each other, wherein at least one of the top parts of the V-shaped wavy portion of the lower plate is an adjacent top part, and at least another one of the top parts of the V-shaped wavy portion is a top part other than the adjacent top part, wherein the adjacent top part is adjacent to at least one of the inlet and the outlet and the adjacent top part is a curved surface having a bend radius of 2 millimeters or larger and 10 millimeters or smaller, wherein an upper surface of the top part other than the adjacent top part has a convex shape protruding toward the upper side, wherein the bottom parts of the wavy portion of the upper plate include at least one bonded bottom part and at least one bottom part other than the bonded bottom part, wherein the bonded bottom part is a curved surface having a bend radius of 2 millimeters or larger and 10 millimeters or smaller, wherein a lower surface of the bottom part other than the bonded bottom part has a convex shape protruding toward the lower side, and wherein a bonded area where the adjacent top part of the lower plate and the bonded bottom part of the upper plate are bonded is larger than a bonded area where the top part other than the adjacent top part of the lower plate and the bottom part other than the bonded bottom part of the upper plate are bonded.

4. The plate heat exchanger of claim 1, wherein one of a bonded bottom part included in the top parts of the wavy portion of the upper plate and being bonded to the adjacent top part and the adjacent top part has a concave portion, and the other has a convex portion, such that the concave portion and the convex portion fit each other when stacked.

5. The plate heat exchanger of claim 1, wherein, in an unstacked state, the adjacent top part is configured to have a larger wave height than the other top parts, and wherein, in a state where the plates are stacked and a load applied thereto, the adjacent top part is configured to be deformed into a planar shape by being squashed by the load.

6. The plate heat exchanger of claim 1, wherein the plates each have a rectangular shape and each have the inlet at one end thereof in a long-side direction and the outlet at the other end thereof, wherein the V-shaped wavy portions of the respective plates each have two ends of the V shape residing on two respective sides, in a short-side direction, of a corresponding one of the plates and a folding point of the V shape residing at a position of the corresponding one of the plates that is displaced in a long-side direction from the two ends, and wherein a folding angle at the folding point of the V shape is larger in a region of the wavy portion having the adjacent top part than in regions of the wavy portion having the other top parts.

7. The plate heat exchanger of claim 1, wherein the plates each have a rectangular shape and each have the inlet at one end thereof in a long-side direction and the outlet at the other end thereof, wherein the V-shaped wavy portions each have two ends of the V shape residing on two respective sides, in a short-side direction, of a corresponding one of the plates and a folding point of the V shape residing at a position of the corresponding one of the plates that is displaced in a long-side direction from the two ends, and wherein a region of the wavy portion having the adjacent top part includes a bent portion that is bent toward a side of the folding point in the long-side direction.

8. The plate heat exchanger of claim 3, wherein the plates each have a rectangular shape and each have the inlet at one end thereof in a long-side direction and the outlet at the other end thereof, wherein the V-shaped wavy portions of the respective plates each have two ends of the V shape residing on two respective sides, in a short-side direction, of a corresponding one of the plates and a folding point of the V shape residing at a position of the corresponding one of the plates that is displaced in a long-side direction from the two ends, and wherein a folding angle at the folding point of the V shape is larger in a region of the wavy portion having the adjacent top part than in regions of the wavy portion having the other top parts.

9. The plate heat exchanger of claim 3, wherein the plates each have a rectangular shape and each have the inlet at one end thereof in a long-side direction and the outlet at the other end thereof, wherein the V-shaped wavy portions each have two ends of the V shape residing on two respective sides, in a short-side direction, of a corresponding one of the plates and a folding point of the V shape residing at a position of the corresponding one of the plates that is displaced in a long-side direction from the two ends, and wherein a region of the wavy portion having the adjacent top part includes a bent portion that is bent toward a side of the folding point in the long-side direction.

10. The plate heat exchanger of claim 1, wherein each one of the V shapes, which are substantially evenly distributed in the wavy portion, of the lower plate corresponds to one of the top parts of the V-shaped wavy portion, wherein the top parts of the V-shaped wavy portion have different shapes, being either the planar shape or the convex shape.

11. The plate heat exchanger of claim 3, wherein each one of the V shapes, which are substantially evenly distributed in the wavy portion, of the lower plate, corresponds to one of the top parts of the V-shaped wavy portion, wherein the top parts of the V-shaped wavy portion have different shapes, being either the planar shape or having the bend radius.

* * * * *